United States Patent [19]

Fulks

[11] Patent Number: 4,726,582

[45] **Date of Patent: * Feb. 23, 1988**

[54] PROGRAMMABLE EXERCISE SYSTEM

[76] Inventor: Kent B. Fulks, 9710 Amberly, Dallas, Tex. 75243

[ * ] Notice: The portion of the term of this patent subsequent to Feb. 11, 2003 has been disclaimed.

[21] Appl. No.: 869,840

[22] Filed: May 28, 1986

Related U.S. Application Data

[63] Continuation of Ser. No. 637,055, Aug. 2, 1984, abandoned.

[51] Int. Cl.[4] ..... A63B 21/24

[52] U.S. Cl. ..... 272/129

[58] Field of Search ..... 272/129

[56] References Cited

U.S. PATENT DOCUMENTS

| | | | |
|---|---|---|---|
| 3,056,895 | 9/1958 | Cohen et al. . | |
| 3,366,903 | 1/1968 | Searle et al. | 310/44 |
| 3,848,467 | 11/1974 | Flavell . | |
| 3,869,121 | 3/1975 | Flavell . | |
| 3,874,659 | 4/1975 | Aharoni . | |
| 3,902,480 | 9/1975 | Wilson . | |
| 3,998,100 | 12/1976 | Pizatella et al. . | |
| 4,063,726 | 12/1977 | Wilson . | |
| 4,082,267 | 4/1978 | Flavell . | |
| 4,138,106 | 2/1979 | Bradley . | |
| 4,184,678 | 1/1980 | Flavell et al. . | |
| 4,235,437 | 11/1980 | Ruis et al. | 272/129 |
| 4,253,662 | 3/1981 | Podolat | 272/123 |
| 4,261,562 | 4/1981 | Flavell . | |
| 4,323,237 | 4/1982 | Jungerwirth . | |
| 4,337,050 | 6/1982 | Engalitcheff, Jr. | 272/130 |
| 4,354,676 | 10/1982 | Ariel . | |
| 4,358,695 | 11/1982 | MacDonald et al. . | |
| 4,518,163 | 5/1985 | Bruder | 272/134 |
| 4,569,518 | 2/1986 | Fulks . | |

FOREIGN PATENT DOCUMENTS 51377 12/1982 European Pat. Off. .

*Primary Examiner*—Leo P. Picard

*Attorney, Agent, or Firm*—Michael A. O'Neil

[57] ABSTRACT

A physical training apparatus having at least one load member for engagement with and movement by an individual throughout a predetermined range of movement. A variable clutch device selectively applies torque from a motor to the load member. A load, having a magnitude which corresponds with the magnitude of torque applied to the load member, is applied to the individual by the load member. A sensor detects the position and direction of movement of the load member. A digital processor, connected to the sensor, controls the magnitude of torque applied to the load member by the clutch as a function of the location and direction of movement of the load member relative to the predetermined range of movement.

16 Claims, 4 Drawing Figures

PROGRAMMABLE EXERCISE SYSTEM

CROSS-REFERENCE TO RELATED APPLICATIONS

This application is a continuation of application Ser. No. 637,055, filed Aug. 2, 1984, now abandoned.

TECHNICAL FIELD

This invention relates to physical training devices and, more particularly to exercising apparatus which is programmable to adjust the user load during a particular exercise according to the position and direction of movement of the apparatus and/or the number of repetitions completed by the user.

BACKGROUND AND SUMMARY OF THE INVENTION

The technique of exercising particular muscle groups in isolation is well-known. Due to its many advantages, this technique has been successfully incorporated into a wide variety of physical training programs, ranging from daily exercise programs to exercise programs designed for the highly competitive athlete. This technique is capable of substantially improving the strength and endurance of the individual. The advantages derived from muscle isolation exercise include the ability to vary the intensity of muscle exercise for different training purposes, the ability to shorten training periods by concentrating on only those muscle groups which are to be trained and the ability to monitor progress more effectively by comparing the performance during successive workout periods. Perhaps the most important feature of the muscle isolation technique is the ability to control the load against which a muscle group must resist throughout a predetermined range of expansion and contraction thereof. Many advantages of isolated muscle exercise depend upon such load control.

Accordingly, many devices have been developed to facilitate load control during isolated muscle exercise. These devices, however, generally utilize either camming, lever or other mechanical means to control the load against which a particular muscle group must resist. Although these devices have been effective to control or vary the load applied, the load variation is generally fixed by the geometry of the mechanical means utilized to vary the load. Therefore, such devices are not adaptable for use in all of the possible physical training programs in which isolated muscle exercise is beneficial.

The present invention comprises a programmable resistance exercising apparatus which overcomes the foregoing and other problems long since associated with the prior art. In accordance with the broader aspects of the invention, the invention comprises at least one load member, such load member having a predetermined range of movement. The load member is adapted for engagement with and movement by an individual. A load is produced by the load member throughout the range of movement thereof in response to the application of torque thereto. Variable torque means selectively applies torque to the load member. Sensor means detect the location and direction of movement of the load member relative to the range of movement thereof. A programmable means, which is operatively connected to the variable torque means and the sensor means, controls the magnitude of torque applied to the load member by the variable torque means as a function of the location and direction of movement of the load member. Thereby, the load produced by the load member may be varied as a function of the location and direction of movement of the load member.

DESCRIPTION OF THE DRAWINGS

A more complete understanding of the invention may be had by referring to the following Detailed Description when taken in conjunction with the accompanying Drawings, wherein.

DETAILED DESCRIPTION

Figure 1:
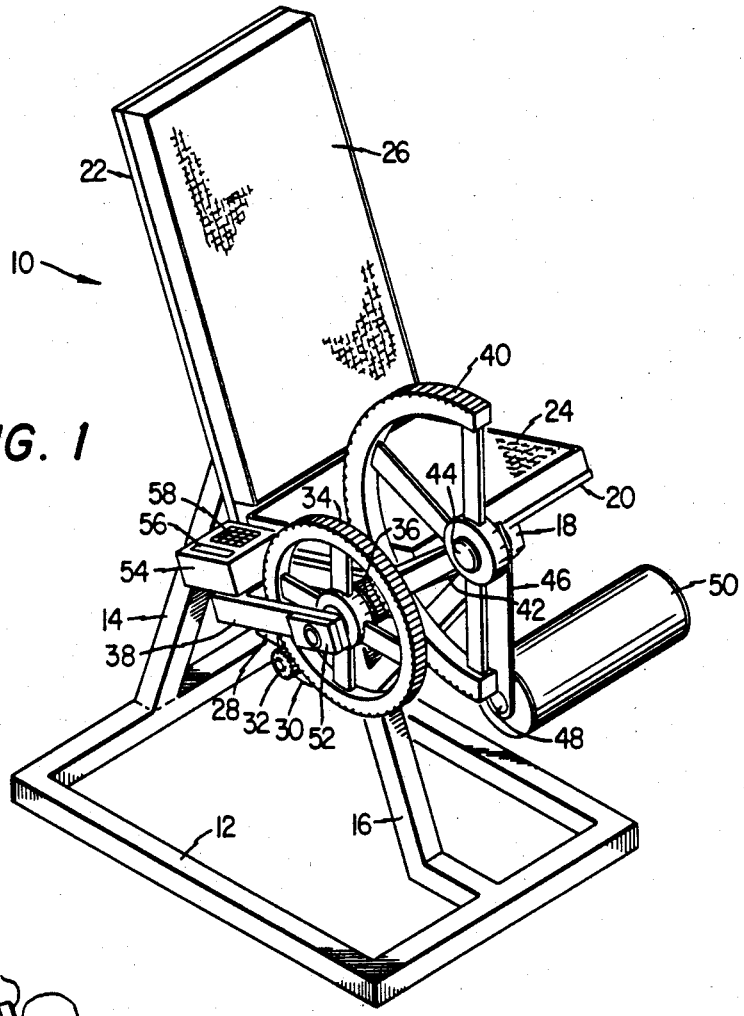
FIG. 1 is a perspective of an exercising apparatus incorporating an embodiment of the invention.
Figure 2:
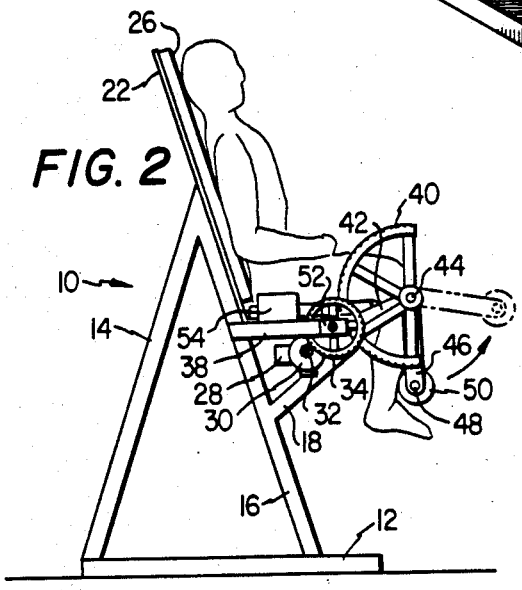
FIG. 2 is a side view of the exercising apparatus of FIG. 1.

Referring now to the Drawings, and particularly to FIGS. 1 and 2 thereof, there is shown an exerciser 10 incorporating the invention. Exerciser 10 includes a rigid rectangular base 12 supporting a rigid frame, comprising members 14, 16 and 18, extending upwardly therefrom. Base 12 and members 14, 16 and 18 typically comprise welded sections of hollow rectangular steel. Attached to the members 14, 16 and 18 is a seat 20 and back support 22, having respective cushions 24 and 26 affixed thereto. An individual using the exerciser 10 is comfortably supported in a sitting position by the seat 20 and back support 22.

Exerciser 10 includes a motor 28 mounted adjacent the underside of seat 20 for providing torque during the operation of exerciser 10. Motor 28 is preferably an electro-mechanical device, however, other types of motors may be suitable for providing torque to exerciser 10 as, for example, a hydraulic motor. Mounted to motor 28 is clutch 30 for selectively engaging a rotary gear 32 to motor 28.

Clutch 30 is preferably adjustable to vary the torque transmitted from motor 28 throughout a predetermined range. It is also preferable that clutch 30 be adjustable to transmit virtually any magnitude of torque within such range, thereby allowing the continual and uninterrupted variance of clutch 30 if desired. Clutch 30 typically comprises a conventional magnetic clutch which is adjusted by varying the voltage or current supplied thereto.

In particular, clutch 30 is preferably a frictionless magnetic clutch which transmits torque by magnetic attraction. In such a clutch, an electromagnetic field is generated to produce the desired magnetic attraction. The torque transmitted is adjusted by varying the intensity of the electromagnetic field. A clutch of this type can be controlled easily and accurately. A suitable clutch, designated as Model AC-502 Clutch, is available from Eaton Corporation of Kenosha, Wis. Clutch 30 may be integrally mounted to motor 28, such as Model M-2 Ajusto-Spede Drive which is also manufactured by Eaton Corporation. As a suitable alternative, a magnetic particle clutch, such as those designated as Model 10 MC*90B and Model 50MC*90B-20, can be utilized in the practice of the invention. Such clutches are manufactured by the Sperry Corporation of Durham, N.C. Although magnetic particle clutches are not frictionless, their wear and torque control characteristics are far superior to conventional clutches and approach the wear and control characteristics of eddy-current clutches, such as the aforementioned eddy-current clutches available from Eaton Corporation.

Torque transmitted from motor 28 by clutch 30 is utilized to provide a load against which an individual using the exerciser 10 must work throughout a predetermined range of movement as he/she exercises. Torque transmitted by the clutch 30 is output through rotary gear 32 and applied to rotary gear 34. Gear 34 engages rotary gear 36, both of which are rotatably mounted in a frame 38. Frame 38 is mounted, in turn, on members 16 and 18 for support thereby. Gears 34 and 36 are keyed to a common axle which transmits torque therebetween such that they rotate synchronously. Torque from gear 36 is applied to rotary gear 40 which is rotatably mounted to support 42 by means of shaft 44. Support 42 is rigidly affixed to frame 38 by suitable means. The diameter of gear 34 is substantially greater than that of gear 36, thereby causing gear 40 to rotate substantially more slowly than gear 32. In addition, the difference in diameters causes a substantially increased magnitude of torque to be applied to gear 40 relative to the torque output from clutch 30. It is preferable that the respective diameters of gears 34 and 36 be chosen to provide a rotational speed reduction ratio of approximately 40:1 between gears 32 and 40.

Gears 40 and rigid arm 46 are fastened to opposite ends of shaft 44 such that support 42 is interposed therebetween. Shaft 44 serves to transmit torque between gear 40 and arm 46 and to maintain synchronous movement of gear 40 and arm 46 about the axis defined thereby. Rigidly mounted to the free end of arm 46 is a shaft 48 in longitudinal alignment with the axis defined by shaft 44. Surrounding shaft 48 is cylindrical cushion 50 for distributing the load applied to the individual by shaft 48 during the operation of exerciser 10.

FIG. 2 shows the position of an individual with respect to exerciser 10 during normal use. With motor 28 rotating in a clockwise direction, torque is transmitted to arm 46, thereby urging shaft 48 and cushion 50 against the front of an individual's legs above his feet. Typically, each repetition of the leg extension exercise, which includes both a positive and a negative stroke, begins with the individual assuming the bent-knee position shown in FIG. 2. As the individual extends his/her legs towards a straight-knee position during the positive stroke, arm 46, shaft 48 and cushion 50 are pivoted to the position shown by phantom outline in FIG. 2. During the negative stroke, arm 46, shaft 48 and cushion 50 return to their original position as the individual retracts his/her legs towards the bent-knee position. It will be apparent that by varying the torque transmitted by clutch 30, a corresponding variance results in the load imposed against the individual by arm 46, shaft 48 and cushion 50.

Exerciser 10 includes means for varying the load against which the individual must resist during the positive and/or negative strokes of each leg extension repetition as a function of the pivotal position and direction of arm 46. The rotational direction and position of arm 46 is detected by utilizing sensor 52. Sensor 52 is affixed to frame 38 for sensing the rotational direction and position of gears 34 and 36, which corresponds directly with the movement and position of arm 46. Sensor 52 may preferably comprise a conventional transducer, such as a potentiometer or an encoded disc assembly, for example. Sensor 52 and clutch 30 are electrically connected to control unit 54 which includes an LED display 56 and a keyboard 58 mounted on the upper face thereof. Control unit 54 is mounted on frame 38 adjacent seat 20 for convenient access by the individual using exerciser 10. Control unit 54 is utilized during operation of the exerciser 10 to vary the torque transmitted by clutch 30, in response to input from sensor 52, and therefore the load against which the individual must resist during exercising.

Figure 3:
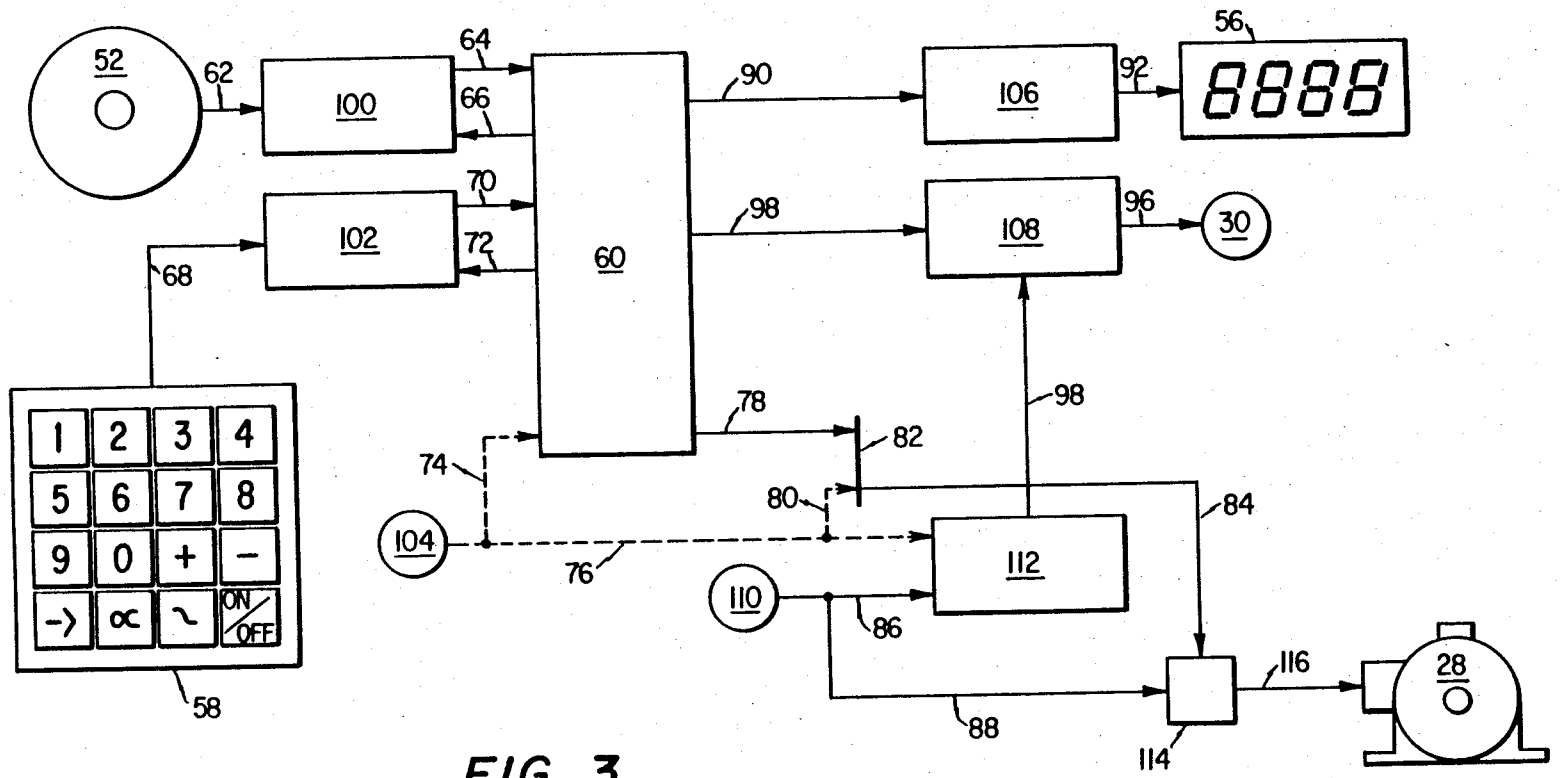
FIG. 3 is a diagrammatic illustration of an embodiment of the programmable control of the invention.

Referring now to FIG. 3, sensor 52, clutch 30, motor 28, display 56 and keyboard 58 of exerciser 10 (shown in FIGS. 1 and 2) are electrically connected to a microprocessor control system. It will be apparent that many, if not all, of the components of the microprocessor control system are located within control unit 54 of FIGS. 1 and 2. Microprocessor 60 serves to control the magnitude of torque transmitted by clutch 50 in response to electrical signals received from sensor 52. More specifically, microprocessor 60 controls clutch 30 according to a program stored in a memory associated therewith. Keyboard 58 is used to input data representing parameters for use by the program. The microprocessor 60 is preferably of the conventional 6805 family.

The control system of FIG. 3 controls clutch 30 and motor 28 to provide a preselected torque output, and a corresponding exercise load, at virtually any point along the positive and negative strokes of a particular exercise repetition. An analog signal representing the instantaneous position and direction of movement of arm 46 is input to the analog-to-digital converter 100 from sensor 52 via line 62. Converter 100 converts the signal received from sensor 52 into a digital signal for input to microprocessor 60 via line 64. Line 66 supplies a synchronization signal from microprocessor 60 to converter 100 to synchronize the analog-to-digital conversion. Microprocessor 60 is programmed to process input from sensor 52 to produce an output corresponding with a desired magnitude of torque transmission by clutch 30. Signals representing such output are applied to regulator 108 via line 94. Direct current is supplied to regulator 108 via line 98 and is applied to clutch 30 via line 96. Regulator 108 controls the magnitude of torque transmitted by clutch 30 by varying the magnitude of either the current or the voltage applied to clutch 30, depending upon the type of magnetic clutch utilized, in response to the signal output from microprocessor 60 on line 94.

Alternating current is supplied to the control system of FIG. 3 by power source 110. Power source 110 supplies current to converter 112 and switch 114 through lines 86 and 88, respectively. In addition, suitable electrical connections are made (not shown) between power source 110 and the remaining A.C. components of the control system of FIG. 3. Converter 112 converts alternating current received from line 86 into filtered direct current for input to regulator 108 via line 98. Motor 28, which is also powered by alternating current, receives power from power source 110 via lines 88 and 116 when switch 114 is closed. Switch 114 may be an electrically actuated relay or control switch, for example.

Motor 28 is started by the closing of normally open switch 114 in response to an electrical signal input thereto via line 84. AND gate 82 transmits an enable signal to switch 114 via line 84 in response to logic high inputs from both lines 78 and 80. AND gate 82 is incorporated to facilitate the inclusion of an optional panic switch circuit (shown by broken lines) with the control system of FIG. 3. However, gate 82 is only necessary if it is desired to include the panic switch 104. Therefore, line 78 would connect directly with line 84 if panic switch 104 is not utilized. In the latter instance, an electrical signal would be output from microprocessor 60 to control switch 114 via lines 78 and 84 to start motor 28 in accordance with the programming of microprocessor 60.

Panic switch 104 may be manually actuated by an individual as he/she uses exerciser 10. When actuated, panic switch 104 sends a logic high signal to microprocessor 60 via line 74 to AND gate 82 via line 80 and to converter 112 via line 76. Therefore, the "status" of panic switch 104 is supplied to microprocessor 60 via line 74, and a signal closing switch 114 will be transmitted from AND gate 82, only when both line 78 and line 80 input logic high signals to AND gate 82. Therefore, motor 28 will run only when panic switch 104 is actuated. Likewise, converter 112 will transmit current to regulator 108 via line 98, for the operation of clutch 30, only when a logic high signal is input to converter 112 from panic switch 104 via line 76. Therefore, neither motor 28 nor clutch 30 will operate without the actuation of panic switch 104. Panic switch 104 may be conveniently located adjacent seat 20 on exerciser 10 such that an individual can manually actuate panic switch 104 while exercising. In the event of an emergency, the individual can disengage clutch 30 and stop motor 28 immediately by activating panic switch 104.

It will be apparent that the control system of FIG. 3 may be adapted to incorporate a panic switch that is normally deactivated during exercising, but which may be actuated by either an instructor or the individual exerciser, for example, to immediately disengage clutch 30 and stop motor 28. It will be apparent that other types of panic switch circuitry may be incorporated with the present invention for safety purposes.

As noted above, input parameters necessary for the operation of the program stored in microprocessor 60 may be input through keyboard 58. Signals from keyboard 58 are input to code converter 102 via line 68. Code converter 102 serves to convert signals received from keyboard 58 into signals which are compatible with microprocessor 60 and to output the converted signals to microprocessor 60 via line 70. Line 72 provides a signal from microprocessor 60 to converter 102 to synchronize the conversion. As will be discussed in greater detail hereinafter, keyboard 58 may be used to input parameters representing virtually an infinite number of combinations of load variations for the positive and/or negative stroke of each exercise repetition.

LED display 56 functions to display useful information regarding the programming of exerciser 10 and/or other information concerning the operation of exerciser 10. Such information may include data entered through keyboard 58, the instantaneous magnitude of torque transmitted by clutch 30 or the load applied against the individual by exerciser 10, the number of repetitions completed or the work done. Other information suitable for display on display 56 will be apparent to those skilled in the art.

Signals representing data desired to be displayed is periodically output from microprocessor 60 via line 90 to code converter 106. Code converter 106 serves to convert data received from microprocessor 60 to a form that is compatible with display 56 and also serves as a driver for display 56. Signals from code converter 106 are output to display 56 via line 92. Incorporation of code converter 106 reduces the time devoted by microprocessor 60 to updating display 56, thus allowing more precise, frequent and smooth control of clutch 30.

Figure 4:
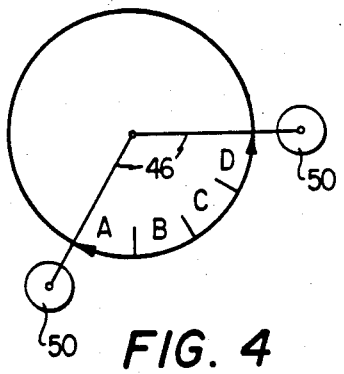
FIG. 4 is an illustration of the range of movement of the exercising apparatus of FIGS. 1 and 2.

FIG. 4 illustrates an example of the load variance which may be achieved by utilizing the control system of FIG. 3. The range of pivotal movement of arm 46 of exerciser 10 is divided into segments A through D. Movement of arm 46 from segment A to a horizontal position in segment D represents the positive stroke of an exercise repetition. Conversely, movement of arm 46 from a horizontal position in segment D to its original position in segment A represents the negative stroke of an exercise repetition.

As discussed previously, the magnitude of torque transmitted by clutch 30 may be varied according to the location and direction of movement of arm 46. Accordingly, a specific magnitude of torque may be selected for each of segments A–D by programming microprocessor 60 appropriately. Microprocessor 60 will adjust clutch 30 to transmit the preselected magnitude of torque for each of segments A–D during the movement of arm 46 therethrough. Since the magnitude of torque transmitted by clutch 30 corresponds directly with the load applied by arm 46, it will be apparent that the control system of FIG. 3 is capable of producing a predetermined load for each of segments A–D. Further, in a similar fashion, a first magnitude of torque may be selected for each of segments A–D throughout the positive stroke of an exercise repetition while a second magnitude of torque may be selected for each of segments A–D throughout the negative stroke of an exercise repetition. Therefore, the load produced for each of segments A–D during the positive stroke of a repetition may differ from the load produced for each of segments A–D during the negative stroke. The adjustment of clutch 30 may preferably be sufficiently gradual to provide a smooth transition between the loads applied throughout each of segments A–D.

It will be apparent that the programming of microprocessor 60 is not limited to segments A–D of FIG. 4. Accordingly, the invention is capable of applying a constant load throughout an exercise repetition, applying a constant load of a first magnitude throughout the positive stroke of a repetition and applying a constant load of a second magnitude throughout the negative stroke of a repetition, or applying a constant load only throughout the positive or negative stroke of a repetition. In addition, the positive and negative strokes of a repetition may be divided into from one to virtually an infinite number of segments, each having a predetermined load assigned thereto. Therefore, the invention is capable of continuous variation of load as a function of the position of arm 46 relative to the positive or negative stroke of an exercise repetition. Further, the invention may be programmed to vary the load in a particular manner for each exercise repetition of a predetermined number or set of repetitions. Thus, the invention provides an exercising apparatus of maximum versatility which is capable of controlling and varying the load applied against an individual throughout an exercise period.

The invention may also be programmed to apply the loads in a variety of ways which have been found to be effective in physical conditioning. For example, a load can be applied during the first repetition of a set of repetitions which is the maximum load movable by the individual. In order to compensate for muscle fatigue, the load may be successively reduced by predetermined amounts for each of the following repetitions so that the individual moves the maximum load which he/she is capable of moving during each of the following repetitions. This procedure may be continued until muscle exhaustion is achieved.

In another application, the invention may be programmed to apply a substantially greater load during the negative stroke of an exercise repetition than is applied during the positive stroke, or vice versa. Typically, an individual will have greater strength in either the positive or negative strokes of a particular exercise. Therefore, this technique may be employed to compensate for such strength differences.

The invention may also be programmed to compensate for changes in muscle leverage throughout the range of movement of an exercise repetition, thereby maintaining substantially constant muscle tension during the repetition. Referring now to FIG. 4, during a typical leg extension repetition, for example, the quadriceps have the least leverage when arm 46 passes through sections A and D. Exerciser 10 may be programmed to reduce the load applied by arm 46 within sections A and D to compensate for the reduction in muscle leverage therein. This concept may be utilized to compensate for muscle leverage changes in virtually any exercise apparatus. Most individuals experience similar muscle leverage changes during each repetition of a particular exercise. Therefore, the invention may be programmed using one standard to effectively compensate for muscle leverage changes in most individuals. Further, such compensation may be represented in the program of the invention by an algorithm, thereby allowing the compensation to be smooth and continuous.

Although the present invention is shown embodied in exerciser 10, which is designed for physical training of the thigh or quadricep muscles, it will be apparent that the concept of the present invention is applicable to and may be utilized with virtually any exercising machine which provides a load against which an individual must resist. Thus, it is apparent that there has been provided, in accordance with the invention, a programmable variable load exercising apparatus that fully satisfies the objects, aims and advantages set forth above. While the invention has been described in conjunction with the specific embodiment thereof, it is evident that many alternatives, modifications, and variations will be apparent to those skilled in the art in view of the foregoing Detailed Description. Accordingly, it is intended to embrace all such alternatives, modifications, and variations as fall within the spirit and scop of the invention.

I claim:

1. An exerciser comprising:

at least one load member having a predetermined range of movement through a positive stroke and a negative stroke for producing a load throughout the predetermined range of movement in response to the application of torque thereto;

an electromechanical meter for providing a torque throughout the period during which the exerciser is in use;

variable torque means for selectively applying the torque provided by said motor to said load member, said variable torque means including an adjustable clutch for receiving the torque from said motor and for selectively varying the magnitude of the torque applied to said load member throughout the positive stroke and the negative stroke of the load member;

sensor means for detecting the location and direction of movement of said load member relative to the predetermined range of movement; and programmable means operatively connected to said clutch and said sensing means for controlling the magnitude of the torque applied to said load member by said clutch as a function of the location and direction of movement of said load members.

2. The exerciser of claim 1 wherein said adjustable clutch includes a magnetic particle clutch.

3. The exerciser according to claim 1, wherein said progammable means includes digital processor means.

4. The exerciser according to claim 3, wherein said sensor means comprises a motion transducer.

5. The exerciser according to claim 3, wherein said sensor means comprises a potentiometer.

6. The exerciser according to claim 3, further comprising:

input means connected to said digital processor means for selectively inputting data thereto which represents at least one parameter utilized by a program of said digital processor means; and a display means for visually presenting data from said digital processor.

7. The exerciser according to claim 3, further comprising safety means for selectively interrupting the application of torque to said load member.

8. A physical training apparatus comprising:

an electromechanical motor for providing torque throughout the period during which the apparatus is in use;

a plurality of load members, each such load member for producing a load throughout a positive stroke and a negative stroke of a predetermined range of movement in response to the application of torque thereto;

a transmission for transmitting and appJying the torque from said motor to said load member, said transmission including an adjustable clutch for receiving torque from said motor and selectively varying the torque transmitted to said load member by said transmission throughout the positive stroke and the negative stroke of the load member;

a sensor for detecting the location and direction of movement of said load member relative to said predetermined range of movement; and a programmable digital processor operatively connected to said clutch and said sensor for varying the torque transmitted to said load member by said transmission as a function of the location and direction of movement of said load member relative to the predetermined range of movement.

9. The physical training apparatus of claim 8, further comprising a safety means for selectively deactivating said motor and said clutch.

10. The physical training apparatus of claim 8 wherein said adjustable clutch includes a magnetic particle clutch.

11. The physical training apparatus of claim 8, further comprising a keyboard connected to said digital processor for inputting at least one parameter to a program of said digital processor to selectively vary the torque transmitted to said load member by said transmission as a function of the location and direction of movement of said load member relative to the predetermined range of movement.

12. The physical training apparatus of claim 11, further comprising a display connected to said digital processor for outputting visually receivable data from said digital processor.

13. The physical training apparatus according to claim 8, further comprising:

a safety means for selectively deactivating said motor and said clutch;

a keyboard connected to said digital processor for inputting at least one parameter to a program of said digital processor to selectively vary the torque transmitted to said load member by said transmission as a function of the location and direction of movement of said load member relative to the predetermined range of movement; and a display connected to said digital processor for outputting visually receivable data from said digital processor.

14. A method for controlling the load applied by an exercising apparatus comprising:

providing an electromechanical motor for supplying a torque throughout the period during which the exercising apparatus is in use;

providing an adjustable clutch for receiving and selectively transmitting said torque from said motor within a predetermined range;

transmitting said torque in the form of a load to a portion of an individual throughout a predetermined range of movement including a positive stroke and a negative stroke;

detecting the location and direction of movement of the portion of the individual relative to the predetermined range of movement;

producing an electrical signal representing the location and direction of movement of the portion of the individual relative to the predetermined range of movement;

processing said electrical signal in accordance with an algorithm to formulate an electrical output signal, said output signal representing the degree of variance of the load which is necessary to substantially compensate for changes in muscle leverage of the individual throughout the predetermined range of movement; and adjusting said clutch in response to said output signal to vary the load applied to the individual throughout the positive stroke and negative stroke of movement in response to said output signal.

15. The method for controlling the load applied by an exercising apparatus according to claim 14, wherein said load is varied to maintain a substantially constant tension in the muscles resisting the load throughout the predetermined range of movement.

16. The method for controlling the load applied by an exercising apparatus according to claim 14 wherein said step of providing an adjustable clutch includes providing a magnetic particle clutch.

* * * * *